US010290968B2

(12) United States Patent
Patton et al.

(10) Patent No.: US 10,290,968 B2
(45) Date of Patent: May 14, 2019

(54) WATERPROOF COAXIAL CABLE CONNECTOR

(71) Applicant: Neptune Technology Group Inc., Tallassee, AL (US)

(72) Inventors: Damon Lloyd Patton, Wetumpka, AL (US); Steven Christopher Wolfe, Montgomery, AL (US); Randall McClay Stoves, Auburn, AL (US)

(73) Assignee: Neptune Technology Group, Tallassee, AL (US)

( * ) Notice: Subject to any disclaimer, the term of this patent is extended or adjusted under 35 U.S.C. 154(b) by 0 days.

(21) Appl. No.: 15/966,331

(22) Filed: Apr. 30, 2018

(65) Prior Publication Data

US 2018/0323534 A1 Nov. 8, 2018

Related U.S. Application Data

(60) Provisional application No. 62/500,371, filed on May 2, 2017.

(51) Int. Cl.
*H01R 13/40* (2006.01)
*H01R 13/52* (2006.01)
(Continued)

(52) U.S. Cl.
CPC ..... *H01R 13/5202* (2013.01); *H01R 9/05* (2013.01); *H01R 13/516* (2013.01);
(Continued)

(58) Field of Classification Search
CPC .... H01R 13/5202; H01R 9/05; H01R 13/516; H01R 13/5205; H01R 13/5219;
(Continued)

(56) References Cited

U.S. PATENT DOCUMENTS 4,170,777 A 10/1979 Liautaud
4,173,761 A 11/1979 Liautaud
(Continued)

OTHER PUBLICATIONS

"BNC Waterproof Connector," Muco Technologies BV, accessed at <http://muco-connectors.nl/products/bnc-waterproof-connector/item/bnc-waterproof-connector>.

*Primary Examiner* — Khiem Nguyen
(74) *Attorney, Agent, or Firm* — Snyder, Clark, Lesch & Chung, LLP

(57) ABSTRACT

A connector assembly connects a coaxial cable, having a first coaxial connector, to a second coaxial connector. The connector assembly includes the coaxial cable conductively connected to a proximal end of the coaxial cable; and an outer housing member having a proximal end and a distal end. The outer housing member includes an internal lumen containing the proximal end of the coaxial cable and at least partially containing the first coaxial connector; a concavity at the proximal end of the outer housing member, wherein the concavity includes an opening that is contiguous with the internal lumen; and a first interlocking connector element in the concavity. The connector assembly further includes at least one sealing body within the internal lumen of the outer housing member, the at least one sealing body forming a watertight seal between the housing and the cable, and a resilient compressible surface surrounding the first coaxial connector.

20 Claims, 10 Drawing Sheets

(51) Int. Cl.

| | |
|---|---|
| ***H01R 9/05*** | (2006.01) |
| ***H01R 13/633*** | (2006.01) |
| ***H01R 24/40*** | (2011.01) |
| ***H01R 13/516*** | (2006.01) |
| ***H01R 43/00*** | (2006.01) |
| *H01R 13/625* | (2006.01) |
| *H01R 13/622* | (2006.01) |
| *H01R 103/00* | (2006.01) |

(52) U.S. Cl.
CPC ..... *H01R 13/5205* (2013.01); *H01R 13/5219* (2013.01); *H01R 13/633* (2013.01); *H01R 24/40* (2013.01); *H01R 43/005* (2013.01); *H01R 13/622* (2013.01); *H01R 13/625* (2013.01); *H01R 2103/00* (2013.01)

(58) Field of Classification Search
CPC .... H01R 13/633; H01R 24/40; H01R 43/005; H01R 13/622; H01R 13/625; H01R 2103/00
USPC ..... 439/578, 587
See application file for complete search history.

(56) References Cited

U.S. PATENT DOCUMENTS

| | | | | |
|---|---|---|---|---|
| 4,179,698 | A | 12/1979 | Liautaud | |
| 4,190,839 | A | 2/1980 | Liautaud | |
| 4,242,684 | A | 12/1980 | Wolverton | |
| 4,523,197 | A | 6/1985 | Imazeki et al. | |
| 4,611,213 | A | 9/1986 | Johnson et al. | |
| 4,867,698 | A | 9/1989 | Griffiths | |
| 4,914,060 | A | 4/1990 | Seas | |
| 5,015,194 | A | 5/1991 | Seas | |
| 5,151,047 | A | 9/1992 | Phillips | |
| 5,278,570 | A * | 1/1994 | Jaramillo | H01Q 1/242 343/702 |
| 6,679,726 | B1 * | 1/2004 | Tunn | H01R 13/6315 439/550 |
| 7,268,734 | B2 | 9/2007 | Cislo | |

* cited by examiner

WATERPROOF COAXIAL CABLE CONNECTOR

CROSS-REFERENCE TO RELATED APPLICATION

This application claims priority under 35 U.S.C. § 119, based on U.S. Provisional Patent Application No. 62/500,371 filed May 2, 2017, the disclosure of which is hereby incorporated herein by reference.

BACKGROUND OF THE INVENTION

The present application relates generally to electrical connectors, and specifically to weatherproof connectors for coaxial cables.

Coaxial connections are widely used to conduct radio frequency signals with little electromagnetic interference from other signals and with minimal power losses when installed next to metal objects. The low vulnerability of coaxial cable to power losses and interference is due to the containment of the magnetic field carrying the signal to a space between an inner conductor surrounded by a tubular insulating layer, surrounded by a tubular conducting shield. Electric and magnetic fields outside the cable are largely kept from interfering with signals inside the cable. To confer these advantages and function as a transmission line, the dimensions of the cable must be controlled to give a precise, constant conductor spacing. Larger diameter cables and cables with multiple shields have less leakage. This property makes coaxial cable a good choice for carrying weak signals that cannot tolerate interference from the environment or for stronger electrical signals that must not be allowed to radiate or couple into adjacent structures or circuits. Common applications of coaxial cable include video, television and radio transmission, and computer data connections.

However, the functionality of coaxial cable depends on the integrity of its structure. For example, any contact at all between the conducting shield and the inner conductor will cause a short circuit, causing complete signal loss. This most often occurs at damaged or improperly installed end connectors and splices. Also, the connector or splice must be properly attached to the shield, as this provides the path to ground the interfering signal.

Consequently, it is important to protect coaxial connections from damage and improper installation. This is especially true in the outdoor environment, where omnipresent moisture can penetrate the connection and enter the cable. It is of course most critical in a submerged environment. Moisture can corrode the cable parts, and also close or short a circuit between the inner connector and the conducting shield. Attempts have been made to develop waterproof coaxial connectors. However, to date all such connectors require the assembly of multiple parts and the use of specialized tools to establish a reliable and waterproof connection. This is a severe disadvantage, as coaxial connections must often be installed outdoors in places that are difficult or dangerous to access.

SUMMARY

Various embodiments of a connector assembly for a coaxial cable described herein include an elastomeric body that creates a watertight seal between an outer housing and both of a coaxial cable that enters the housing and a coaxial connector at the end of the coaxial cable.

In one aspect, a connector assembly for connecting a coaxial cable, having a first coaxial connector, to a second coaxial connector is provided. The connector assembly includes the coaxial cable, the first coaxial connector conductively connected to a proximal end of the coaxial cable, configured to connect to the second coaxial connector; and an outer housing member having a proximal end and a distal end, the outer housing member including an internal lumen containing the proximal end of the coaxial cable and at least partially containing the first coaxial connector, a concavity at the proximal end of the outer housing member, wherein the concavity includes an opening that is contiguous with the internal lumen, and a first interlocking connector element in the concavity. The connector assembly further includes at least one sealing body within the internal lumen of the outer housing member, the at least one sealing body forming a watertight seal between the housing and the cable; and a resilient compressible surface encircling or surrounding the first coaxial connector.

In another aspect, an outer housing member for a coaxial connector is provided. The outer housing member may have a proximal end and a distal end. The outer housing member includes: an internal lumen configured to contain a proximal end of a coaxial cable and configured to at least partially contain a first coaxial connector connected to the proximal end of the coaxial cable; a concavity at the proximal end of the outer housing member, wherein the concavity includes an opening that is contiguous with the internal lumen; a first interlocking connector element located in the concavity; at least one sealing body within the internal lumen of the outer housing member, the at least one sealing body configured to form a watertight seal between the housing and the cable; and a resilient compressible surface configured to surrounding the first coaxial connector.

In still another aspect, a process for making a connector assembly for a coaxial cable is provided. The process includes: providing a coaxial cable having a longitudinal axis, a proximal end, and a distal end; inserting the coaxial cable into an internal lumen of an elongated outer housing member having a proximal end and a distal end, the housing member comprising a concavity at the proximal end of the housing member, and wherein the concavity includes an opening that is contiguous with the lumen; conductively connecting a coaxial connector to the proximal end of the coaxial cable and positioned wherein the coaxial connector partially protrudes into the concavity; forming a watertight seal between a portion of the coaxial cable within the lumen and the housing member; and providing a compressible elastomeric body in the concavity.

The above presents a simplified summary to provide a basic understanding of some aspects of the claimed invention. This summary is not an extensive overview. It is also not intended to identify key or critical elements or to delineate the scope of the claimed subject matter. Its sole purpose is to present some concepts in a simplified form as a prelude to the more detailed description provided below.

DETAILED DESCRIPTION OF THE PREFERRED EMBODIMENTS

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

A connector assembly is disclosed that provides a watertight seal between its housing, a coaxial cable, and a coaxial connector. The connector provides a watertight connection in a single assembly by use of one or more elastomeric bodies between the housing, coaxial cable, and coaxial connector. The connector assembly prevents the infiltration of moisture and can be assembled in a single step without specialized tools. Consequently, no additional assembly is required during installation, except to connect the (first) coaxial connector with a complementary (second) coaxial connector. In this context the terms "watertight" and "waterproof" refer to the ability to exclude water under approximately atmospheric pressure. Some embodiments of the connector provide a watertight seal under higher pressures, such as those found in submerged environments. Such higher pressures may include (but are not limited to) 1 kilopascal (kPa), 3 kPa, 10 kPa, 100 kPa, 1 megapascal (MPa), 10 MPa, 30 MPa, 60 MPa, 100 MPa, 1000 MPa, approximately (±10%) any of the foregoing, any range between the foregoing, and at least any of the foregoing.

Figure 1:
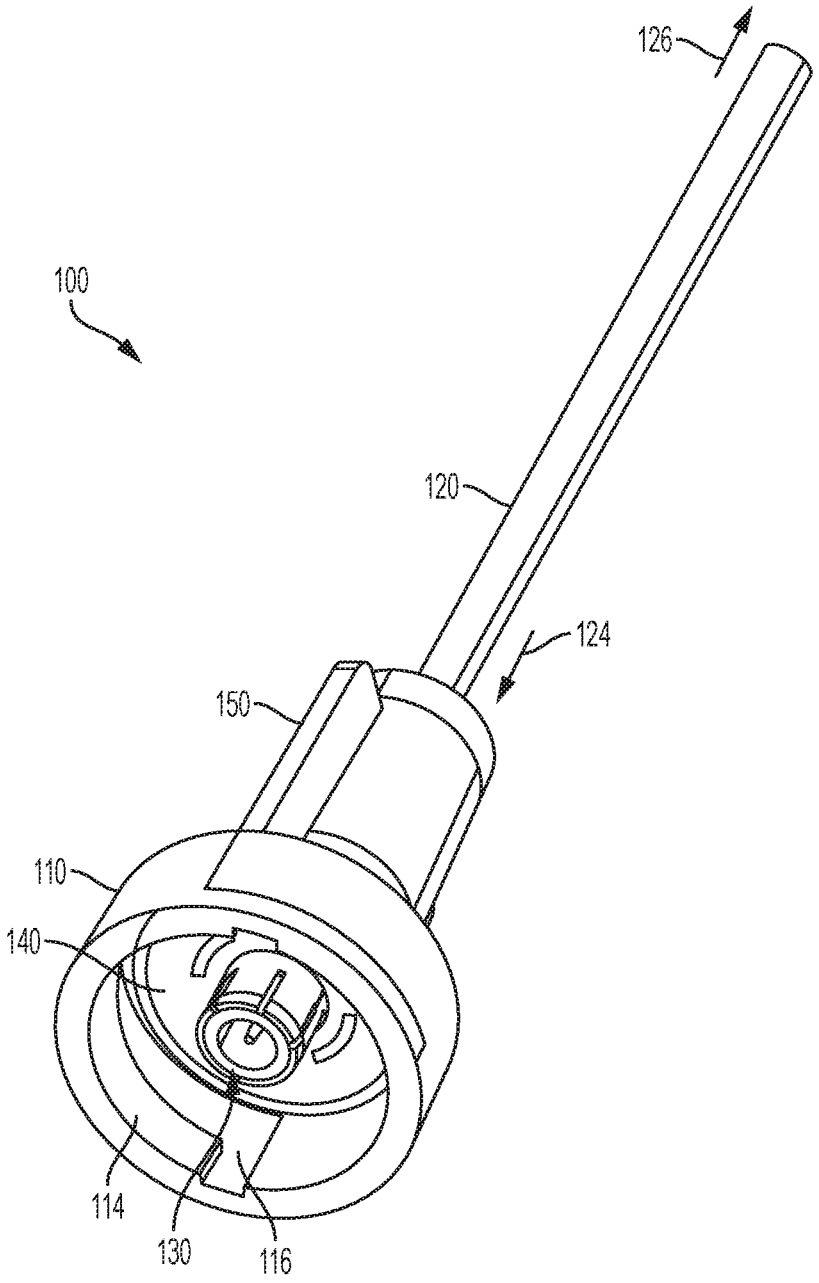
FIG. 1 is a perspective view of an embodiment of the connector assembly.
Figure 2:
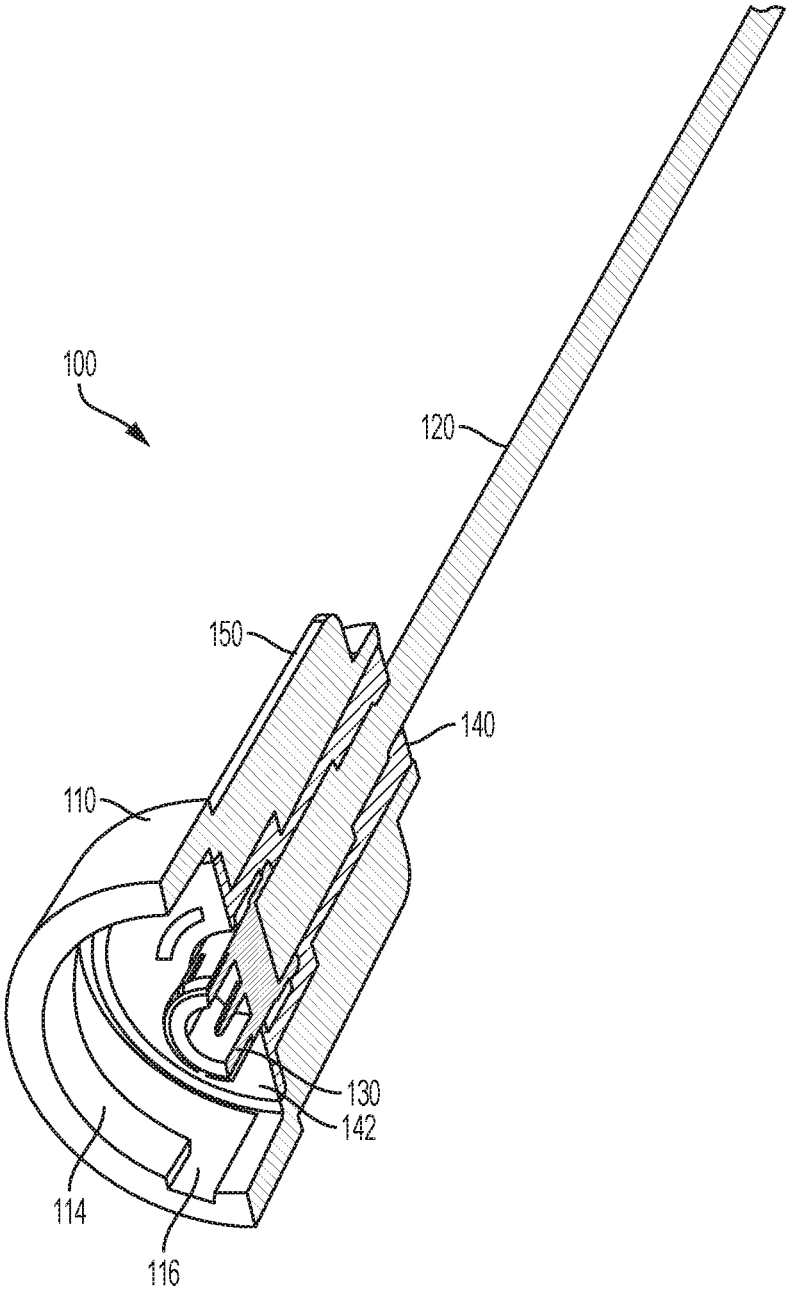
FIG. 2 is a longitudinal cross-section of the embodiment of the connector shown in FIG. 1.
Figure 3:
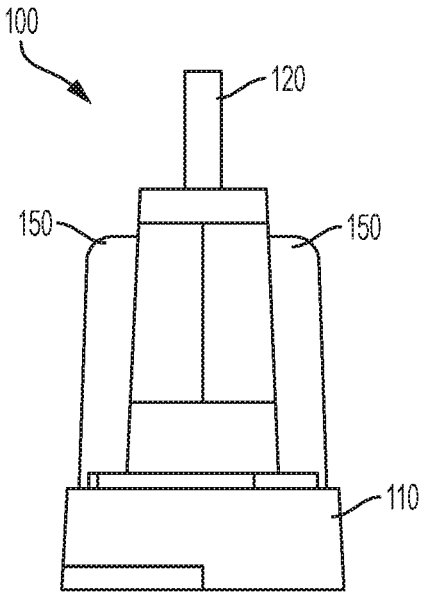
FIG. 3 is a side plan view of the embodiment of the connector shown in FIG. 1.
Figure 4:
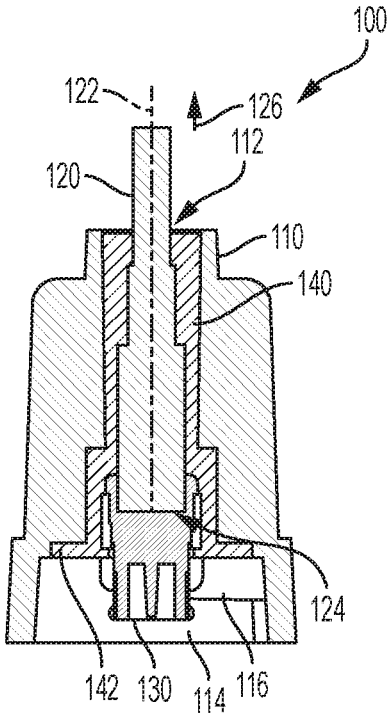
FIG. 4 is a cross-sectional side plan view of the embodiment of the connector shown in FIG. 1.

FIGS. 1-9 provide various views of an embodiment of a connector assembly 100. As generally shown in FIGS. 1-9, connector assembly 100 includes a coaxial cable 120, a first coaxial connector 130 electrically connected to the cable 120, an outer housing 110 around the cable 120 and at least part of the first coaxial connector 130, and an elastomeric body 140 forming a watertight seal between the housing 110 and both of the cable 120 and the first coaxial connector 130. The coaxial cable 120 is of any suitable construction, and, as best shown in FIG. 4, can generally be said to have a longitudinal axis 122, a proximal end 124, and a distal end 126. The first coaxial connector 130 is located at the proximal end 124 of the cable 120, and may be either a male or female standard push-on coaxial connector. For example, the first coaxial connector 130 may be an F-type coaxial connector.

Figure 5:
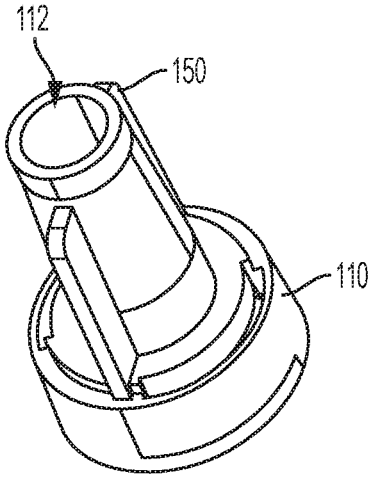
FIG. 5 is a perspective view of the isolated housing assembly of the embodiment of the connector shown in FIG. 1.
Figure 6:
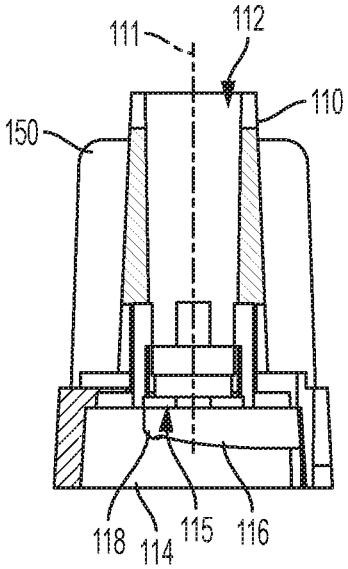
FIG. 6 is a cross-sectional side plan view of the isolated housing assembly of the embodiment of the connector shown in FIG. 1.

The housing 110 is constructed of a rigid material, such as a rigid polymer material. As shown in FIGS. 4-6, for example, the housing 110 contains an internal lumen or hole 112, which contains the proximal end 124 of the cable 120 and partially contains the first coaxial connector 130. The lumen 112 extends through at least a portion of the housing 110 along a longitudinal axis 111 (FIG. 6), which may substantially align with axis 122 of the cable 120 when the cable 120 is installed within the lumen 112. As shown in FIG. 6, for example, portions of the lumen 112 may have different diameters orthogonal to longitudinal axis 111. The lumen 112 is contiguous with an opening 115 of a proximal concavity 114. The first coaxial connector 130 may extend from lumen 112 through opening 115 and partially protrude into the area surrounded by the concavity 114.

In addition to providing a watertight seal, the elastomeric body 140 forms a resilient compressible surface 142 (FIG. 2) within the area surrounded by the concavity 114. The compressible surface 142 can provide a watertight seal against a complementary (or second) connector assembly 200 (FIG. 7), as further described below. The elastomeric body 140 can be constructed of any suitably durable and elastomeric material, such as silicone, butyl rubber polyamide, polyester, olefin, styrenics, urethane, and a composite of a thermoplastic and cured rubber. More specific examples include room temperature vulcanization silicone, uncured ethylene-propylene-diene-monomer (EPDM) blended with polypropylene, styrene-butadiene-styrene block polymer, styrene-ethylene-butylene-styrene block polymer, cured ethylene-propylene-diene copolymer/polypropylene blend, cured isobutylene isoprene rubber/polypropylene blend, and cured nitrile butadiene rubber/polyvinylchloride blend. The elastomeric material 140 may have a relatively low melting temperature, to facilitate assembly with the coaxial cable 120 without heat-induced damage. Some embodiments of the elastomeric body 140 are unitary in construction, i.e., formed of a single piece of elastomeric material. Such a unitary body may be held in place or sealed with a sealant or adhesive, or in direct contact with the other structures in the connector assembly 100. Some embodiments of the elastomeric body 140 do not need to move (i.e., either translate or deflect) relative to the housing to achieve a watertight fit. In such embodiments, the elastomeric body acts as a static plug between the housing 110 and the cable 120 and connector 130.

As also shown in FIG. 6, a slot 116 for a bayonet connection is present on the side of the concavity 114. The bayonet slot 116 may be substantially L-shaped and comprise a detent 118 that accommodates a bayonet connector post (e.g., bayonet connector post 240, FIG. 7) of a complementary connector assembly (e.g., assembly 200, FIG. 7).

The detent 118 may be configured to provide a tactile indication when the bayonet connector post 240 is in place in the detent 118. The bayonet slot 116 and the bayonet connector post 240 may be referred to generically as interlocking connector elements.

Figure 7:
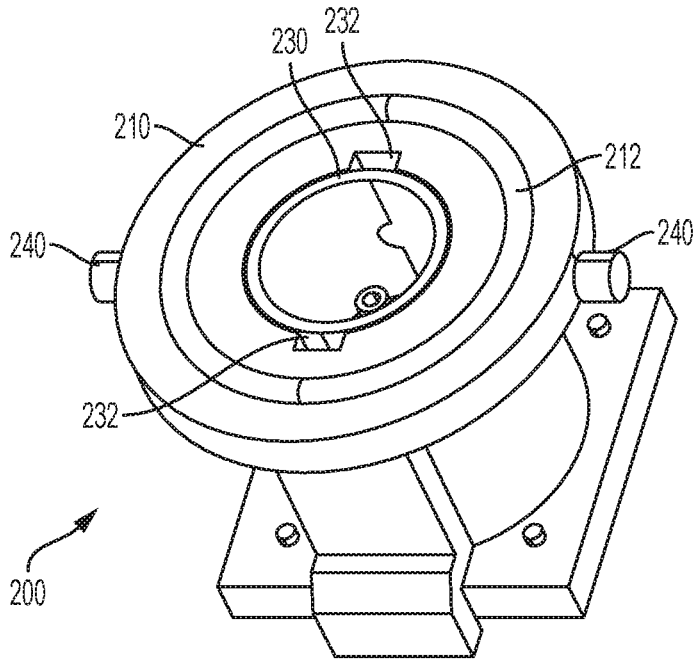
FIG. 7 is a perspective view of an embodiment of a complementary connector for the connector shown in FIG. 1.
Figure 8:
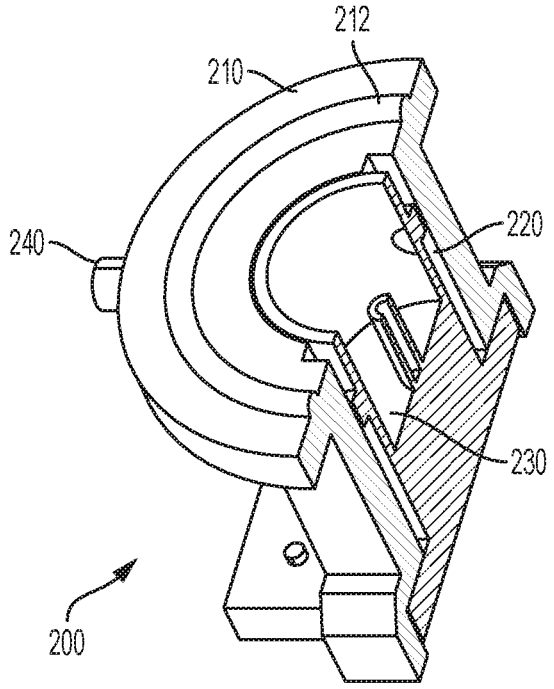
FIG. 8 is a longitudinal cross-section of the embodiment of the complementary connector shown in FIG. 7.
Figure 9:
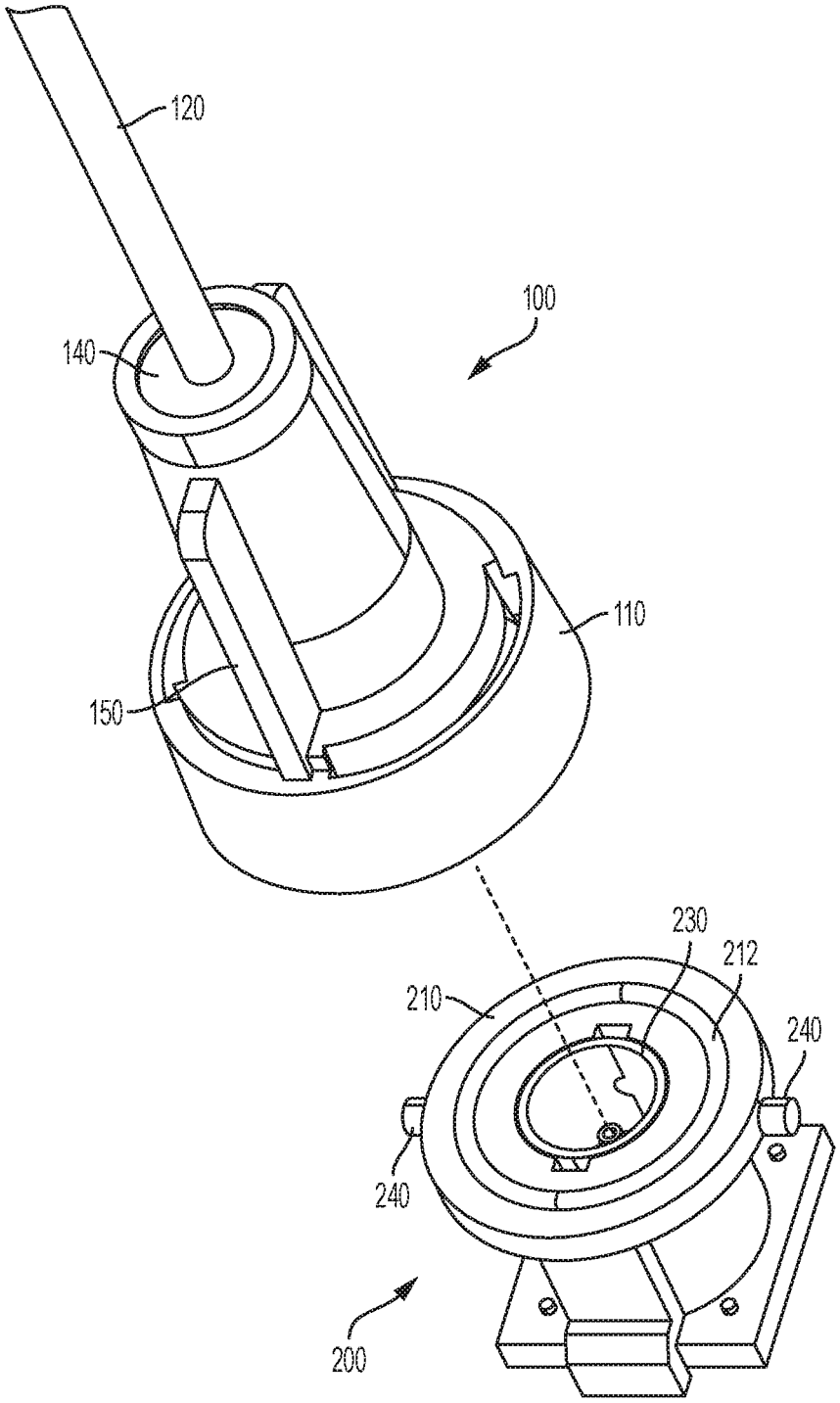
FIG. 9 is an assembly view of the connector of FIG. 1 and the complementary connector of FIG. 7.
Figure 10:
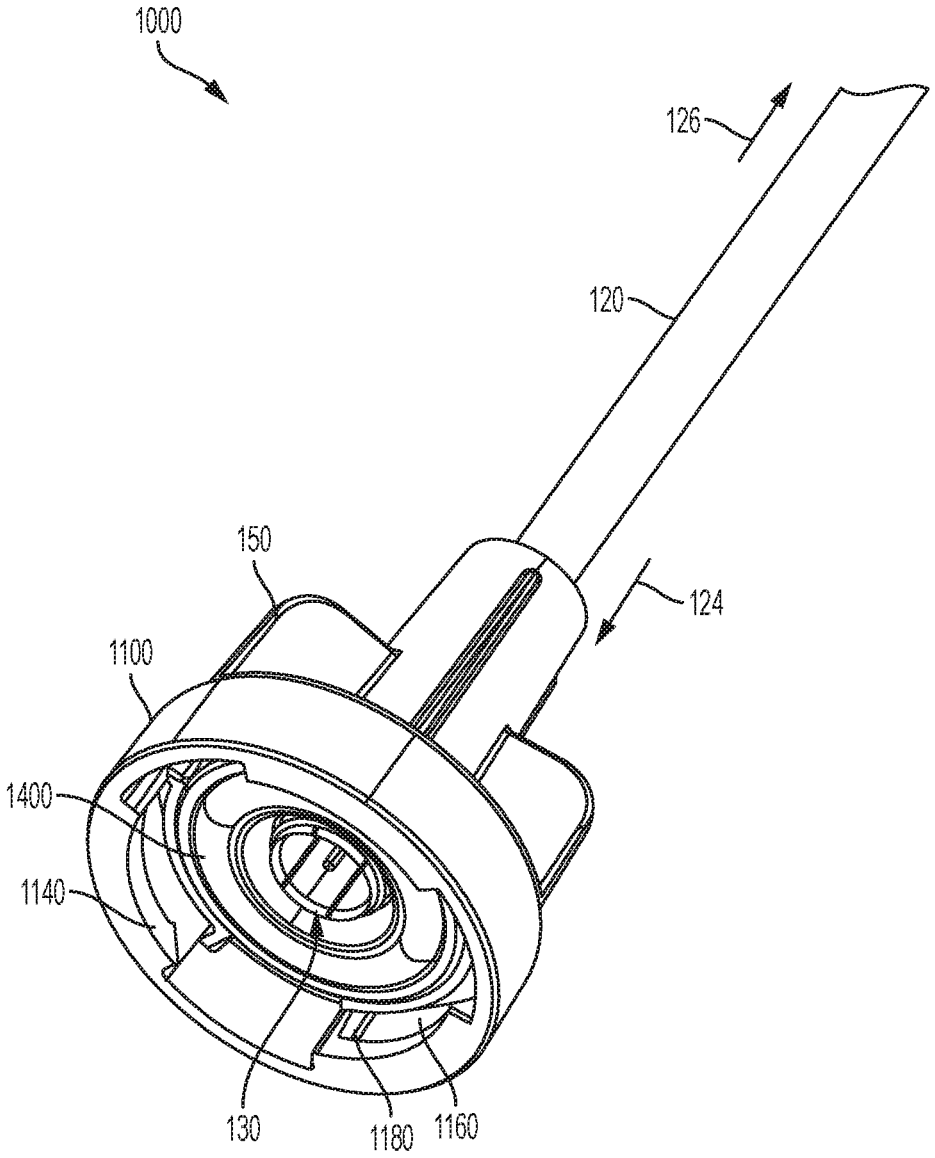
FIG. 10 is a perspective view of another embodiment of the connector assembly.
Figure 11:
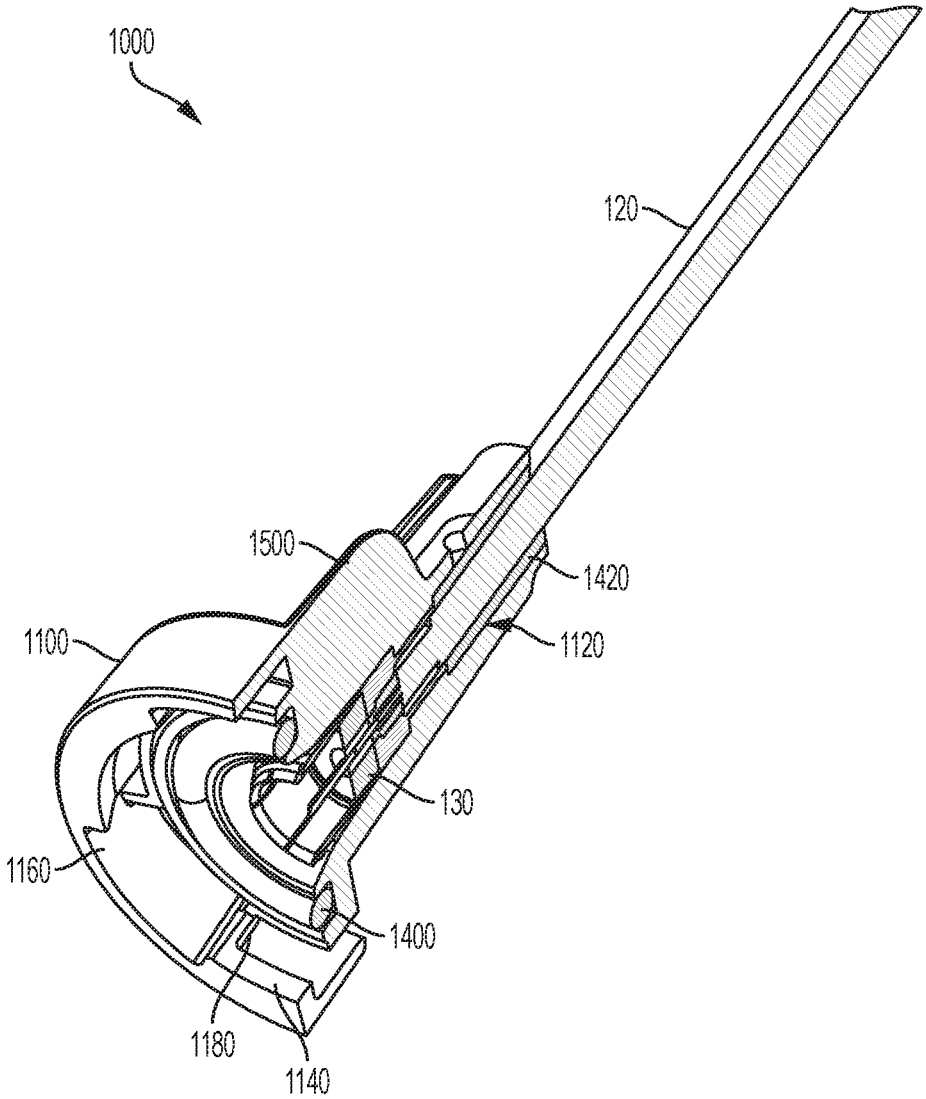
FIG. 11 is a longitudinal cross-section of the embodiment of the connector shown in FIG. 10.
Figure 12:
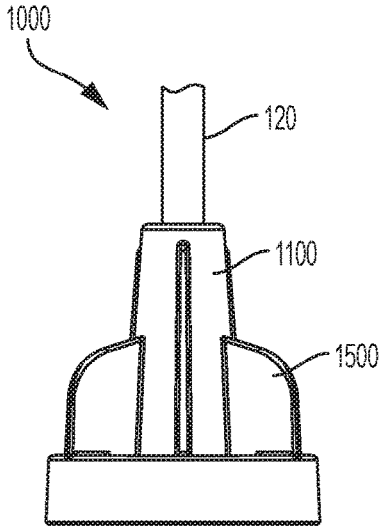
FIG. 12 is a side plan view of the embodiment of the connector shown in FIG. 10.
Figure 13:
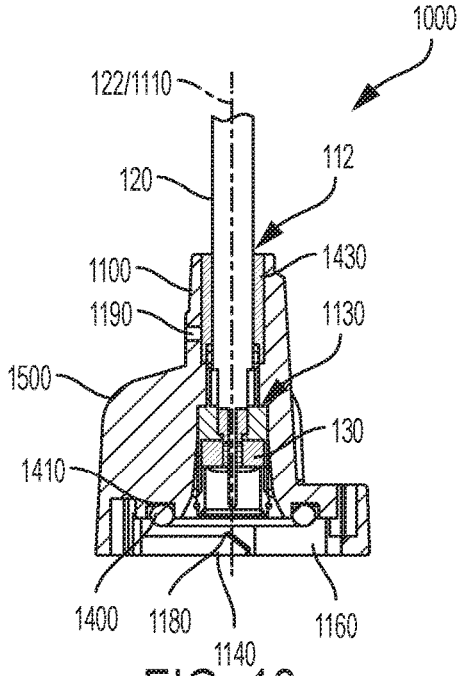
FIG. 13 is a cross-sectional side plan view of the embodiment of the connector shown in FIG. 10.
Figure 14:
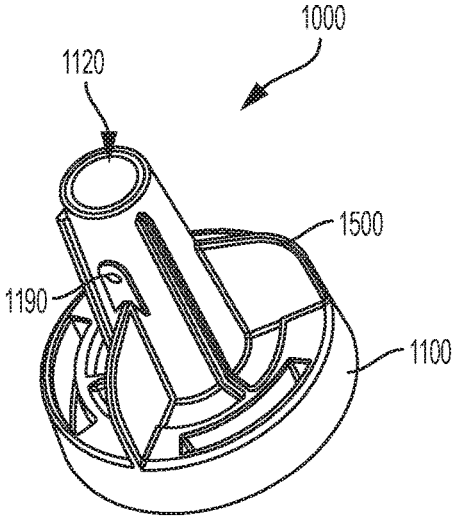
FIG. 14 is a perspective view of the isolated housing assembly of the embodiment of the connector shown in FIG. 10.

As shown in FIG. 9, the connector assembly 100 may be connected to a second complementary connector assembly 200. The connector assembly 200 may include a second coaxial connector 230. The second coaxial connector 230 may be connected to a second cable (in which case it is a splice) or it may be connected to hardware that originates, receives, or modifies the radio frequency signal carried by the first coaxial cable 120. As shown in FIGS. 7-9, the second connector assembly 200 has a contact surface 210 shaped to fit within the area surrounded by the concavity 114 and against the elastomeric body 140.

As shown in FIG. 8, an elongated lumen or cavity 220 is positioned within the contact surface 210. The lumen 220 is dimensioned to contain the second coaxial connector 230, which is complementary to the first coaxial connector 130 (i.e., if the first coaxial connector 130 is male, the second coaxial connector 230 is female, and vice-versa). In the illustrated embodiment, the lumen 220 comprises two diametrically opposed slots 232 to accommodate the tabs on a standard female coaxial antenna connector, but the slots 232 may be absent in embodiments intended for other types of connections.

The illustrated embodiment of the second connector assembly 200 in FIGS. 7-9 includes a pair of bayonet connector posts 240 that lock into the bayonet connector slots 116 of the first connector assembly 100 when the contact surface 210 fits against the elastomeric body 140. Particularly, the connector posts 240 may slide along the respective slots 116 until posts 240 rest in the respective detents 118. The second coaxial connector 230 is positioned within the lumen 220, such that the second coaxial connector 230 is fully engaged to the first coaxial connector 130 when the bayonet connector posts 240 are locked in the bayonet connector slots 116, and such that the contact surface 210 exerts compressive force on the elastomeric body 140 sufficient to provide a watertight interface.

When installed within the concavity 114 against the elastomeric body 140, the contact surface 210 of second connector assembly 200 exerts compressive force against the elastomeric body 140 (e.g., at compressible surface 142), which exerts a counterforce when compressed, resulting in a leakless or watertight fit. In the illustrated embodiment of FIGS. 7-9, the contact surface 210 has a raised gasket ring 212 portion. The raised gasket ring 212 creates a region of increased compressive force against the elastomeric body 140 to enhance the watertight seal. In the illustrated embodiment, the raised gasket ring 212 is integral with the contact surface 210, but in other implementations, a separate gasket structure could be provided.

During installation (e.g., a field operation), the connector posts 240 of the second connector assembly 200 are inserted into the slots 116 of the first connector assembly 100. One or both of the first coaxial connector assembly 100 and second coaxial connector assembly 200 may be rotated around their longitudinal axes (e.g., axis 122) to lock the bayonet connection (e.g., to position the bayonet connector posts 240 in the detents 118 of the bayonet connector slots 116). In one implementation, the elastomeric body 140 is immobile relative to the housing 110 and the cable 120. Thus, the housing 110, the cable 120, the coaxial connector 130, and the elastomeric body 140 of first connector assembly 100 may rotate as a single component. The rotation of the first coaxial connector assembly 100 relative to the second connector assembly 200 may be limited to a half turn (e.g., 180 degrees) or less, as established by the length and/or amount of the slots 116.

Although in some cases the push and turn operation may be performed by hand by pinching the connector housing 110 between the fingers, in those embodiments requiring high torque to achieve a watertight connection, handholds may be necessary to allow an installer to exert sufficient torque by hand. The use of such handholds can avoid the undesirable use of tools during installation. As shown in FIGS. 1, 3, 5, and 6, for example, the handhold may take the form of one or more wings 150 extending radially from the housing 110. The wings 150 are be configured to bear the load associated with rotation of the housing 110 by the installer. More particularly, a force tangential to the circumference of concavity 114 may be applied to one or more of wings 150, causing housing 110 to rotate. As shown in FIGS. 1-9, a specific embodiment of the connector assembly comprises two wings 150 disposed about 180 degrees from one another on the housing 110, distal to the concavity 114. Other possible forms of the handhold include a high-friction patch to accommodate a user's thumb, a knob, ridges, and other means to facilitate purchase of the user's hands or fingers.

While FIGS. 1-9 show a configuration with the first connector assembly 100 and the second connector assembly 200 joined using a bayonet-type interlocking connector elements, according to another implementation, the first connector assembly 100 and the second connector assembly 200 may be joined using a different type of interlocking connector elements, such as snap-fit interlocking connector elements. For example, instead of the slots 116, the concavity 114 in the first connector assembly 100 may include cantilever snap-fit elements to receive the connector posts 240 of the second connector assembly 200 (or another structure that may clip into place). The snap-fit elements and the connector posts 240 may be configured to form a permanent snap-fit or a reusable snap-fit.

Figure 15:
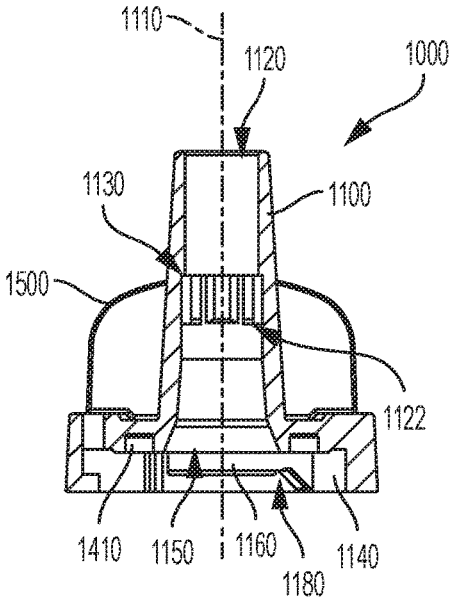
FIG. 15 is a cross-sectional side plan view of the isolated housing assembly of the embodiment of the connector shown in FIG. 10.
Figure 16:
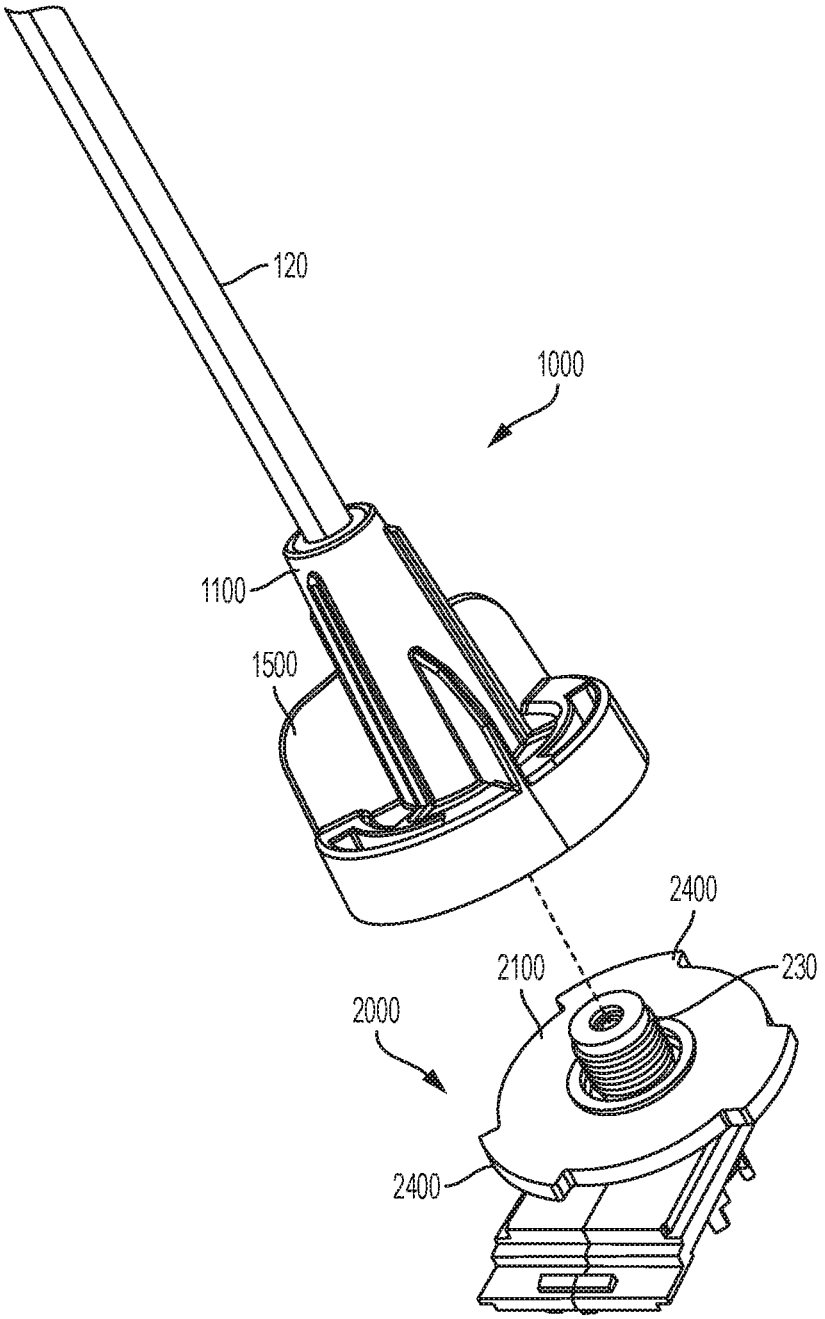
FIG. 16 is an assembly view of the connector of FIG. 10 and a standard complementary connector.

FIGS. 10-16 provide various views of another embodiment of a connector assembly 1000. In contrast with connector assembly 100 described above, connector assembly 1000 is configured to be connected to a connector assembly 2000 (FIG. 16).

An embodiment of the connector assembly 1000 comprises the coaxial cable 120, the first coaxial connector 130 electrically connected to the cable 120, an outer housing 1100 around the cable 120 and at least part of the first coaxial connector 130, an elastomeric body 1400 within a concavity 1140, and an elastomeric ring 1430 (FIG. 13) forming a watertight seal between the housing 1100 and the cable 120 at a distal end of connector assembly 1100.

Like the housing 110 described above, the housing 1110 is constructed of a rigid material, such as a rigid polymer material. As shown in FIGS. 11-15, the housing 1110 contains an internal lumen or hole 1120, which contains the proximal end 124 of the cable 120 and partially contains the first coaxial connector 130. The lumen 1120 extends through at least a portion of housing 1100 along a longitudinal axis 1110. The lumen 1120 is contiguous with an opening 1150 of the proximal concavity 1140. The first coaxial connector 130 may extend from lumen 1120 through opening 1150 and partially protrude into the area surrounded by the concavity 1140.

As shown in FIG. 15, for example, portions of the lumen 1120 may have different diameters extending orthogonally to longitudinal axis 1110. In one implementation, the different diameters of lumen 1120 form a shoulder 1130 against which the first coaxial connector 130 abuts to constrain the first coaxial connector 130 from sliding out of the distal end of lumen 1120. Additionally as shown in FIG. 15, in one embodiment, a portion of the wall of the lumen 1120 may include indentations 1122 conforming to an outer shape of the first coaxial connector 130. When assembled in connector assembly 1000, the first coaxial connector 130 may fit within the indentions 1122 to prevent independent rotation of connector 130 within housing 1100.

As also shown in FIG. 15, a slot 1160 for a bayonet connection is present on the side of the concavity 1140. The bayonet slot 1160 may comprise a detent 1180 that accommodates a bayonet connector tabs or post (e.g., tab 2400, FIG. 16) of a complementary connector assembly (e.g., 2000, FIG. 16). The detent 1180 may be configured to provide a tactile indication when the bayonet connector tab 2400 is in place in the detent 118. The bayonet slot 1160 and the bayonet connector tab 2400 may be referred to generically as bayonet connector elements.

According to one implementation, the elastomeric body 1400 may be constrained within a channel 1410 along an interior surface of the concavity 1140. The elastomeric body 1400 may provide a watertight seal when compressed against a contact surface 2100 of the second connector assembly 2000. The elastomeric body 1400 also forms a resilient compressible surface 1420 within the concavity 1140. The elastomeric body 1400 and the elastomeric ring 1430 can be constructed of any suitably durable and elastomeric material, similar to materials for elastomeric body 140 described above. However, the elastomeric body 1400 and the elastomeric ring 1430 may not necessarily be formed from the same material. For example, the elastomeric ring 1430 may be a potted component formed from a fluid polymer injected through a port 1190, while the elastomeric body 1400 may include a pre-configured gasket inserted into the channel 1410.

Connection of the first connector assembly 1000 and the second connector assembly 2000 may be performed by hand, similar to operations described above for first connector assembly 100 and the second connector assembly 200. During installation (e.g., a field operation), the connector posts 240) of the second connector assembly 2000 are inserted into the slots 1160 of the first connector assembly 1000. The housing 1100, the cable 120, and the coaxial connector 130 of first connector assembly 1000 may be rotated as a single component relative to the second connector assembly 2000. The rotation of the first coaxial connector assembly 100 relative to the second connector assembly 200 may be limited to a one-third (e.g., 120 degrees) or less, as established by the length and/or amount of the slots 1160.

Wings 1500 extending radially from housing 1100 may be used to provide torque when rotating first connector assembly 1000. As shown in FIGS. 10-16, a specific embodiment of the connector assembly 1000 comprises three wings disposed about 120 degrees from one another on the housing 1100, distal to the concavity 1140. In other implementations, a high-friction patch to accommodate a user's thumb, a knob, ridges, etc., may be included to facilitate application of the user's hands or fingers to housing 1100.

As shown in FIG. 16, the second connector assembly 2000 has a contact surface 2100 shaped to fit within the concavity 1140 against the elastomeric body 1400. The contact surface exerts compressive force against the elastomeric body 1400, and the elastomeric body 1400 exerts a counterforce when compressed within channel 1410, resulting in a leakless or watertight fit. Similar to the connector assembly 200, the second connector assembly 2000 also includes a second coaxial connector 230, which is complementary to the first coaxial connector 130. The illustrated embodiment of FIG. 16 comprises a set of three bayonet connector tabs 2400 that lock into the bayonet connector slots 1600 when the contact surface 2100 fits against the elastomeric body 1400. The second coaxial connector 230 is positioned within a lumen of contact surface 2100, such that the second coaxial connector 230 is fully engaged to the first coaxial connector 130 when the bayonet connector posts 2400 are locked in the bayonet connector slots 1160, and such that the contact surface 2100 exerts compressive force on the elastomeric body 1400 sufficient to provide a watertight interface.

A process 1700 is provided for making a connector assembly for a coaxial cable, such as any of the embodiments described above. Process 1700 may include inserting the coaxial cable into the internal lumen of the housing member (block 1710), connecting the first coaxial connector to the cable (block 1720), and positioning the first coaxial connector so that it partially protrudes into the concavity (block 1730). For example, in the embodiment of FIGS. 1-6, the proximal end 124 of the coaxial cable 120 may be inserted through the lumen 112 of the housing 110 and beyond the proximal end of the concavity 114. The coaxial connector 130 may be conductively attached to the proximal end 124, and the housing 110 may be slid down the cable 120 so that the coaxial connector 130 is positioned at the junction of the lumen 112 and the concavity 114.

Similarly, in the embodiment of FIGS. 10-15, the proximal end 124 of the coaxial cable 120 may be inserted through the lumen 1120 of the housing 1100 and beyond the proximal end of the concavity 1140. The coaxial connector 130 may be conductively attached to the proximal end 124 and the housing 1100 may be slid down the cable 120 so that the coaxial connector 130 is positioned at the junction of the lumen 1120 and the concavity 1140. In one implementation, the shoulder 1130 provides a stopping point to position the coaxial connector 130 at the junction of the lumen 1120 and the concavity 1140.

Process 1700 may also include forming a watertight seal around a portion of the coaxial cable within the lumen (block 1740), and providing a compressible elastomeric body in a concavity of the housing member (block 1750). For example, in the embodiment of FIGS. 1-6, the lumen 112 may be substantially filled, and concavity 114 may be partially filled, with a fluid polymer. The fluid polymer may be solidified to form the compressible elastomeric body 140. The fluid polymer may be, for example, a thermoset or a thermoplastic. General examples of suitable thermoplastic elastomers include a polyamide, silicone, polyester, olefin, styrenics, urethane, and a composite of a thermoplastic and cured rubber. More specific examples include room temperature vulcanization silicone, uncured EPDM blended with polypropylene, styrene-butadiene-styrene block polymer, styrene-ethylene-butylene-styrene block polymer, cured ethylene-propylene-diene copolymer/polypropylene blend, cured isobutylene isoprene rubber/polypropylene blend, and cured nitrile butadiene rubber/polyvinylchloride blend.

As another example of process blocks 1740 and 1750, in the embodiment of FIGS. 10-15, a portion of lumen 1120 may be filled with the fluid polymer (e.g., using port 1190) and the fluid polymer may be solidified to form the elastomeric ring 1430, which forms a watertight seal between the cable 120 and the interior wall of the lumen 1120. Additionally, elastomeric body 1400 may be inserted into channel 1410. Elastomeric body 1400 may be secured within channel 1410, for example, via an interference fit, an adhesive, or another mechanical attachment mechanism.

In some implementations, process 1700 may further include backfilling the lumen with a second fluid elastomer (block 1760). For example, the lumen 112 may be backfilled with additional fluid elastomer (which may be the same or different in composition to the first elastomer) to ensure a good seal between the housing 110/1100 and the cable 120. In one embodiment, the second elastomer is introduced into any remaining space around the cable 120. In some more specific embodiments, the second elastomer is also introduced into the concavity 114/1140, forming a sealing layer over the protruding compressible elastomeric body 140/1400. In further embodiments, the second elastomer is introduced into any remaining space between the compressible elastomeric body 140/1400 and the housing member 110/1100. The compressible elastomeric body 140/1400 may be adhered or sealed to the other structures in the connector assembly 100/1000 by applying the second fluid polymer, such as polyurethane.

A waterproof connector assembly is provided for connecting a coaxial cable, having a first coaxial connector, to a second coaxial connector. The connector assembly includes the coaxial cable, the first coaxial connector conductively connected to a proximal end of the coaxial cable, configured to connect to the second coaxial connector; and an outer housing member having a proximal end and a distal end. The outer housing member includes an internal lumen containing the proximal end of the coaxial cable and at least partially containing the first coaxial connector; a concavity at the proximal end of the outer housing member, wherein the concavity includes an opening that is contiguous with the internal lumen; and a first interlocking connector element in the concavity. The connector assembly further includes at least one sealing body within the internal lumen of the outer housing member, the at least one sealing body forming a watertight seal between the housing and the cable, and a resilient compressible surface encircling or surrounding the first coaxial connector. The waterproof connector assembly provides simplified attachment using a push-on coaxial connector, eliminating alignment challenges of threaded connectors and complexities of some three-piece waterproofing designs used for some coaxial connector assemblies. The waterproof connector assembly may be used to connect an outdoor device, such as a water meter, to an antenna or transmitter.

Figure 17:
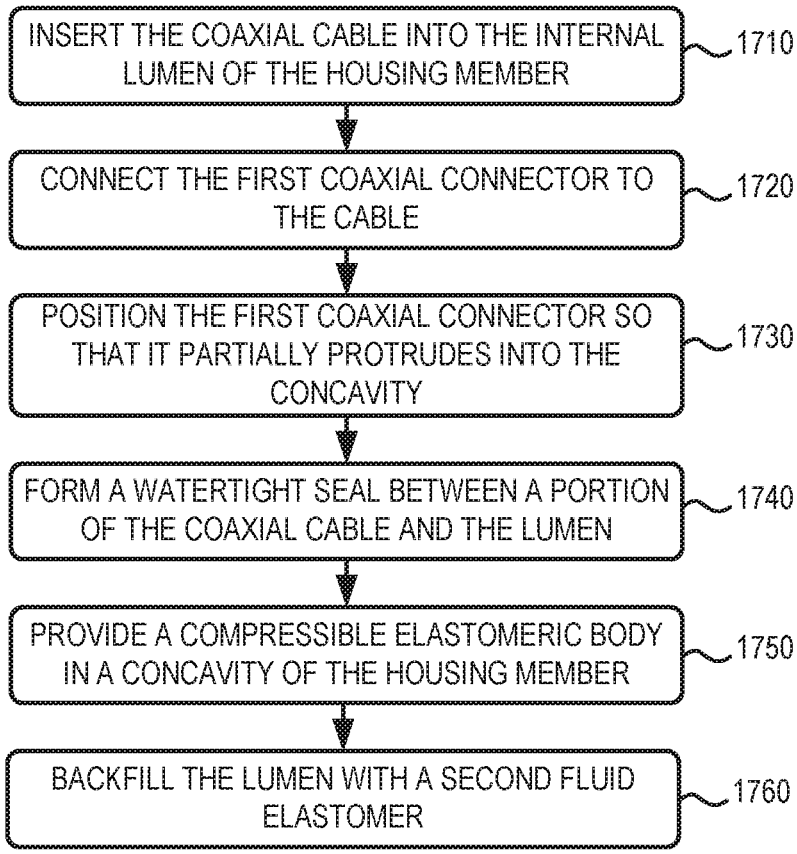
FIG. 17 is a flow diagram illustrating an exemplary process for manufacturing a connector assembly according to an implementation described herein.

The foregoing description of implementations provides illustration and description, but is not intended to be exhaustive or to limit the invention to the precise form disclosed. Modifications and variations are possible in light of the above teachings or may be acquired from practice of the invention. For example, while a series of blocks have been described with regard to FIG. 17, the order of the blocks and message/operation flows may be modified in other embodiments. Further, non-dependent blocks may be performed in parallel.

Use of ordinal terms such as "first," "second," "third," etc., in the claims to modify a claim element does not by itself connote any priority, precedence, or order of one claim element over another, the temporal order in which acts of a method are performed, the temporal order in which instructions are performed, etc., but are used merely as labels to distinguish one claim element having a certain name from another element having a same name (but for use of the ordinal term) to distinguish the claim elements.

No element, act, or instruction used in the description of the present application should be construed as critical or essential to the invention unless explicitly described as such. Also, as used herein, the articles "a," "an," and "the" are intended to include one or more items. Further, the phrase "based on" is intended to mean "based, at least in part, on" unless explicitly stated otherwise. The term "and/or" is intended to be interpreted to include any and all combinations of one or more of the associated items. The word "exemplary" is used herein to mean "serving as an example." Any embodiment or implementation described as "exemplary" is not necessarily to be construed as preferred or advantageous over other embodiments or implementations.

As set forth in this description and illustrated by the drawings, reference is made to "an exemplary embodiment," "an embodiment," "embodiments," etc., which may include a particular feature, structure or characteristic in connection with an embodiment(s). However, the use of the phrase or term "an embodiment," "embodiments," etc., in various places in the specification does not necessarily refer to all embodiments described, nor does it necessarily refer to the same embodiment, nor are separate or alternative embodiments necessarily mutually exclusive of other embodiment (s). The same applies to the term "implementation," "implementations," etc.

With reference to the use of the words "comprise" or "comprises" or "comprising" in the foregoing description and/or in the following claims, unless the context requires otherwise, those words are used on the basis and clear understanding that they are to be interpreted inclusively, rather than exclusively, and that each of those words is to be so interpreted in construing the foregoing description and the following claims.

It is to be understood that any given elements of the disclosed embodiments of the invention may be embodied in a single structure, a single step, a single substance, or the like. Similarly, a given element of the disclosed embodiment may be embodied in multiple structures, steps, substances, or the like.

All structural and functional equivalents to the elements of the various aspects set forth in this disclosure that are known or later come to be known to those of ordinary skill in the art are expressly incorporated herein by reference and are intended to be encompassed by the claims. No claim element of a claim is to be interpreted under 35 U.S.C. § 112(f) unless the claim element expressly includes the phrase "means for" or "step for."

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

The invention claimed is:

1. A connector assembly for connecting a coaxial cable, having a first coaxial connector, to a second coaxial connector, the connector assembly comprising:

the coaxial cable, having a proximal end;

the first coaxial connector conductively connected to the proximal end of the coaxial cable, wherein the first coaxial connector is configured to connect to the second coaxial connector;

an outer housing member having a proximal end and a distal end, the outer housing member comprising:

an internal lumen containing the proximal end of the coaxial cable and at least partially containing the first coaxial connector, a concavity at the proximal end of the outer housing member, wherein the concavity includes an opening that is contiguous with the internal lumen, and a first interlocking connector element located in the concavity;

at least one sealing body within the internal lumen of the outer housing member, the at least one sealing body forming a watertight seal between the housing and the cable; and a resilient compressible surface surrounding the first coaxial connector.

2. The connector assembly of claim 1, wherein the concavity includes a channel encircling the first coaxial connector, and wherein the resilient compressible surface is included within the channel.

3. The connector assembly of claim 2, wherein the at least one sealing body within the internal lumen is at the distal end of the outer housing member.

4. The connector assembly of claim 1, wherein the at least one sealing body fills the internal lumen of the housing and forms the resilient compressible surface within the concavity.

5. The connector assembly of claim 1, wherein the at least one sealing body is an elastomeric body filling the internal lumen of the housing and forms the resilient compressible surface within the concavity.

6. The connector assembly of claim 1, wherein the resilient compressible surface is a gasket encircling the first coaxial connector.

7. The connector assembly of claim 1, wherein the first coaxial connector is located within the internal lumen.

8. The connector assembly of claim 1, further comprising a complementary connector having a proximal end, the complementary connector comprising:

a contact surface shaped to fit within the concavity against the resilient compressible surface;

an elongated lumen extending in a distal direction from the contact surface;

a second interlocking connector element configured to lock into the first interlocking connector element when the contact surface abuts the resilient compressible surface; and the second coaxial connector positioned within the elongated lumen, such that the second coaxial connector is conductively engaged to the first coaxial connector when the second interlocking connector element is locked to the first interlocking connector element, and wherein the contact surface exerts compressive force on the resilient compressible surface sufficient to provide a watertight interface.

9. The connector assembly of claim 1, wherein the first interlocking connector element is a bayonet connector slot, and wherein the bayonet connector slot comprises a detent that provides a tactile indication when a bayonet connector post is locked into the bayonet connector slot.

10. The connector assembly of claim 1, further comprising a first gripping element and a second gripping element on the outer housing member, the first and the second gripping elements configured to rotate the connector assembly when tangential force is applied to at least one of the first and the second gripping elements.

11. The connector assembly of claim 10, wherein at least one of the first and the second gripping elements is a wing.

12. The connector assembly of claim 10, further comprising a third gripping element on the outer housing member configured to rotate the connector assembly when tangential force is applied to at least one of the first, the second, and the third gripping elements.

13. The connector assembly of claim 1, wherein the at least one sealing body is immobile relative to the housing member.

14. The connector assembly of claim 1, wherein the first interlocking connector element is a bayonet connector slot, and wherein the connector assembly comprises at least two bayonet connector slots in the concavity.

15. The connector assembly of claim 1, wherein the first coaxial connector is a push-on connector.

16. The connector assembly of claim 1, wherein the first interlocking connector element and the second interlocking connector element are joined using a snap fit.

17. An outer housing member for a coaxial connector, the outer housing member having a proximal end and a distal end, the outer housing member comprising:

an internal lumen configured to contain a proximal end of a coaxial cable and configured to at least partially contain a first coaxial connector connected to the proximal end of the coaxial cable;

a concavity at the proximal end of the outer housing member, wherein the concavity includes an opening that is contiguous with the internal lumen;

a first interlocking connector element located in the concavity;

at least one sealing body within the internal lumen of the outer housing member, the at least one sealing body configured to form a watertight seal between the housing and the cable; and a resilient compressible surface configured to surrounding the first coaxial connector.

18. The outer housing member of claim 17, wherein the concavity includes a channel configured to encircle the first coaxial connector, and wherein the resilient compressible surface is included within the channel.

19. A method for making a connector assembly for a coaxial cable, the method comprising:

providing a coaxial cable having a longitudinal axis, a proximal end, and a distal end;

inserting the coaxial cable into an internal lumen of an elongated outer housing member having a proximal end and a distal end, the housing member comprising a concavity at the proximal end of the housing member, and wherein the concavity includes an opening that is contiguous with the lumen;

connecting a coaxial connector to the proximal end of the coaxial cable;

positioning the coaxial connector so as to partially protrude into the concavity;

forming a watertight seal between a portion of the coaxial cable within the lumen and the housing member; and providing a compressible elastomeric body in the concavity.

20. The method of claim 19, wherein forming the watertight seal around a portion of the coaxial cable comprises:

substantially filling the lumen with a fluid polymer when the coaxial cable in the lumen; and solidifying the fluid polymer.

* * * * *